US010519669B1

(12) United States Patent
Pattenaude

(10) Patent No.: US 10,519,669 B1
(45) Date of Patent: Dec. 31, 2019

(54) ROTATING GUTTER SYSTEM

(71) Applicant: Keith Pattenaude, Gaylord, MI (US)

(72) Inventor: Keith Pattenaude, Gaylord, MI (US)

( * ) Notice: Subject to any disclaimer, the term of this patent is extended or adjusted under 35 U.S.C. 154(b) by 0 days.

(21) Appl. No.: 16/237,689

(22) Filed: Jan. 1, 2019

(51) Int. Cl.

| | |
|---|---|
| ***E04D 13/00*** | (2006.01) |
| ***E04D 13/076*** | (2006.01) |
| ***E04D 13/072*** | (2006.01) |
| ***E04D 13/064*** | (2006.01) |
| ***E04D 13/068*** | (2006.01) |

(52) U.S. Cl.
CPC ..... *E04D 13/076* (2013.01); *E04D 13/0645* (2013.01); *E04D 13/0685* (2013.01); *E04D 13/0727* (2013.01)

(58) Field of Classification Search
CPC ..... E04D 13/076; E04D 13/0645; E04D 13/0685; E04D 13/0727; E04D 13/0722
USPC ..... 52/11, 12
See application file for complete search history.

(56) References Cited

U.S. PATENT DOCUMENTS

| | | | | |
|---|---|---|---|---|
| 3,630,473 | A * | 12/1971 | Landis | E04D 13/076 248/48.2 |
| 4,117,635 | A * | 10/1978 | Nelson | E04D 13/0645 405/119 |
| 4,411,108 | A * | 10/1983 | Kerester | E04D 13/076 248/48.2 |
| D353,189 | S | 12/1994 | Crowley | |
| 5,526,611 | A | 6/1996 | Leahy | |
| 5,548,931 | A | 8/1996 | Bryant | |
| 5,893,239 | A * | 4/1999 | Leahy | E04D 13/076 248/48.2 |
| 5,896,706 | A | 4/1999 | Pike | |
| 6,389,755 | B1 * | 5/2002 | Wenner | E04D 13/064 248/48.1 |
| 8,215,080 | B2 | 7/2012 | McNeish | |
| 8,234,819 | B2 * | 8/2012 | Petrov | E04D 13/0645 248/48.2 |
| 8,464,474 | B2 * | 6/2013 | Johnson | E04D 13/064 52/11 |
| 8,511,000 | B2 * | 8/2013 | Rees | E04D 13/064 248/48.1 |
| 9,010,028 | B2 | 4/2015 | Hutchings, Jr. | |
| 9,702,150 | B2 * | 7/2017 | Hall | E04D 13/0722 |
| 2002/0125377 | A1 * | 9/2002 | Miller | E04D 13/0722 248/48.2 |

(Continued)

FOREIGN PATENT DOCUMENTS

| | | |
|---|---|---|
| WO | 2008028214 | 3/2008 |

*Primary Examiner* — Beth A Stephan

(57) ABSTRACT

The rotating gutter system is configured for use with a pitched roof. The pitched roof is further defined with a fascia. The rotating gutter system is configured to capture and remove water from the pitched roof. The rotating gutter system is a self-cleaning system. Specifically, each gutter rotates such that debris will fall out of the rotating gutter system allowing for the smooth flow of water through the rotating gutter system. The rotating gutter system is assembled in the same manner as a traditional gutter system. The rotating gutter system comprises a gutter structure and a plurality of segmented bushings. The gutter structure handles the collection and transport of water from the pitched roof. The plurality of segmented bushings: a) attach the gutter structure to the fascia of the pitched roof; and, b) rotate the gutters contained in the gutter structure in order to clean the rotating gutter system.

11 Claims, 9 Drawing Sheets

(56) References Cited

U.S. PATENT DOCUMENTS

| | | | | |
|---|---|---|---|---|
| 2003/0033756 | A1* | 2/2003 | Adams | E04D 13/072 52/11 |
| 2009/0249703 | A1* | 10/2009 | Desotell | E04D 13/0765 52/12 |
| 2009/0255190 | A1* | 10/2009 | Kennedy | E04D 13/0725 52/11 |
| 2013/0111824 | A1* | 5/2013 | Rees | E04D 13/064 52/12 |
| 2016/0289972 | A1 | 10/2016 | Johnson | |

* cited by examiner

ROTATING GUTTER SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of fixed construction and building including roofs and gutters including special arrangements for gutters, more specifically, a cleaning tool configured for use with a gutter. (E04D13/07665)

SUMMARY OF INVENTION

The rotating gutter system is configured for use with a pitched roof. The pitched roof is further defined with a fascia. The rotating gutter system is configured to capture and remove water from the pitched roof. The rotating gutter system is a self-cleaning system. Specifically, each gutter rotates such that debris will fall out of the rotating gutter system allowing for the smooth flow of water through the rotating gutter system. The rotating gutter system is assembled in the same manner as a traditional gutter system. The rotating gutter system comprises a gutter structure and a plurality of segmented bushings. The gutter structure handles the collection and transport of water from the pitched roof. The plurality of segmented bushings: a) attach the gutter structure to the fascia of the pitched roof; and, b) rotate the gutters contained in the gutter structure in order to clean the rotating gutter system.

These together with additional objects, features and advantages of the rotating gutter system will be readily apparent to those of ordinary skill in the art upon reading the following detailed description of the presently preferred, but nonetheless illustrative, embodiments when taken in conjunction with the accompanying drawings.

In this respect, before explaining the current embodiments of the rotating gutter system in detail, it is to be understood that the rotating gutter system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rotating gutter system.

It is therefore important that the claims be regarded as including such equivalent construction insofar as they do not depart from the spirit and scope of the rotating gutter system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
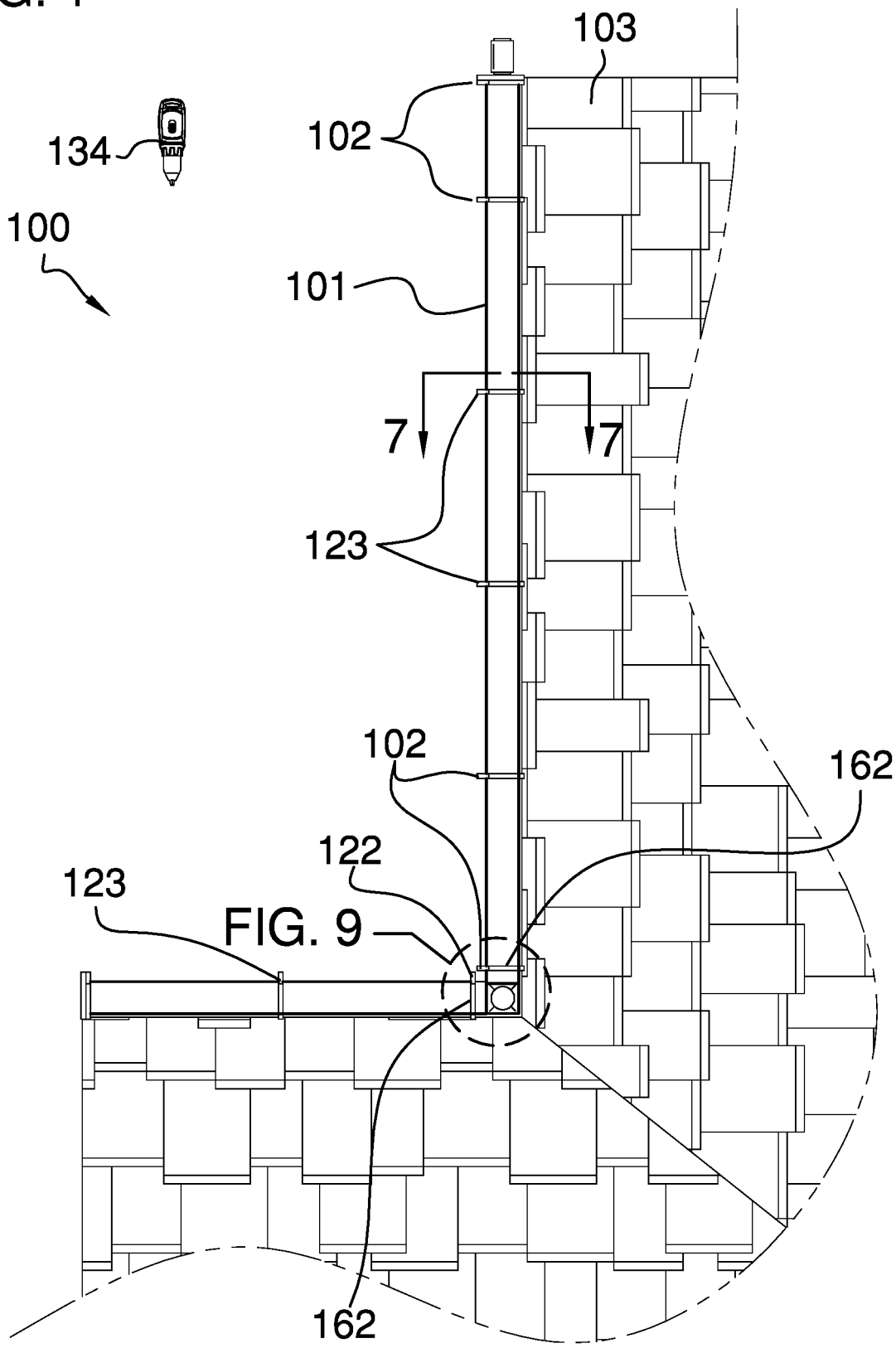
FIG. 1 is an in-use view of an embodiment of the disclosure.
Figure 2:
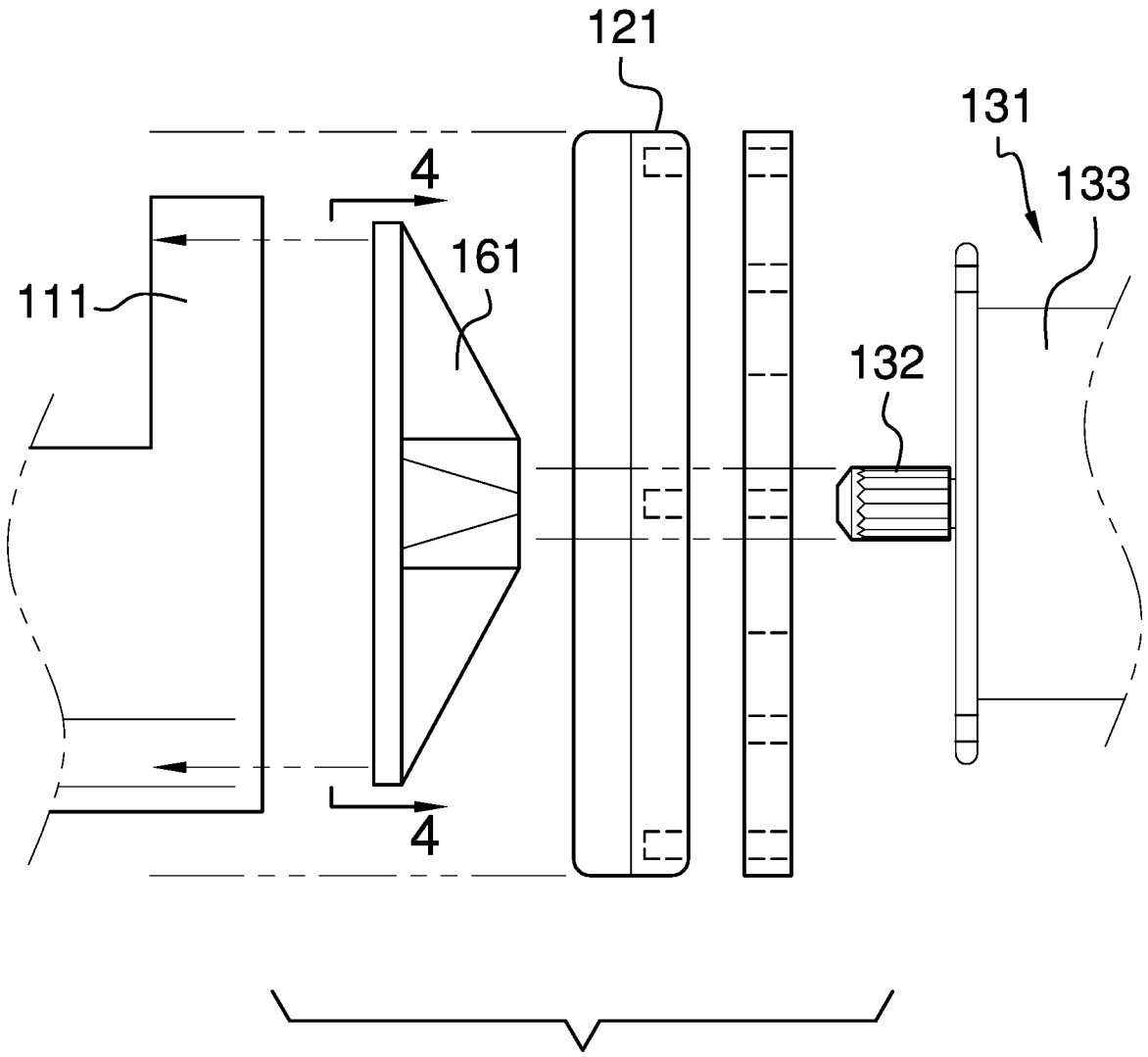
FIG. 2 is an exploded view of an embodiment of the disclosure.
Figure 3:
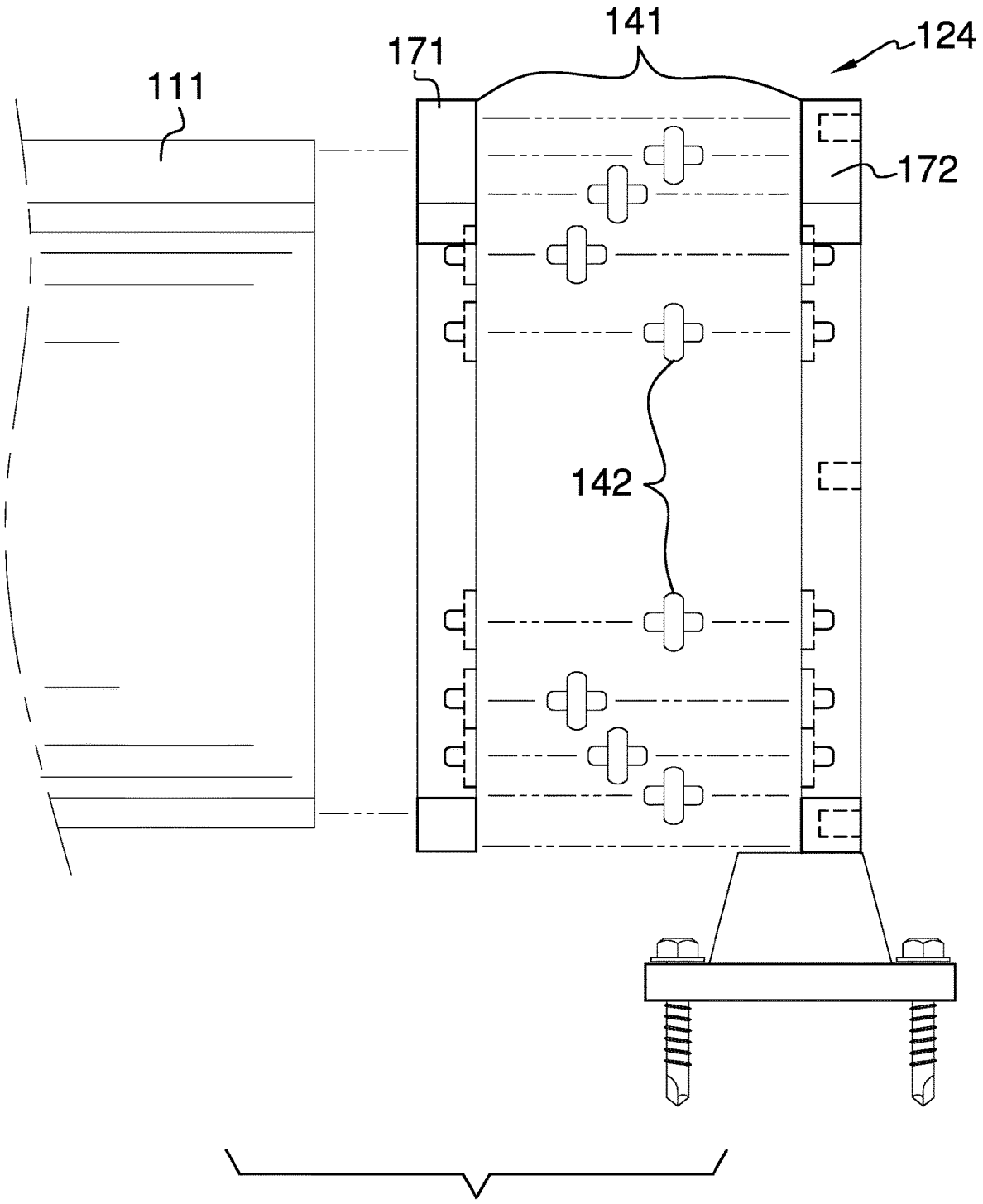
FIG. 3 is a top view of an embodiment of the disclosure.
Figure 4:
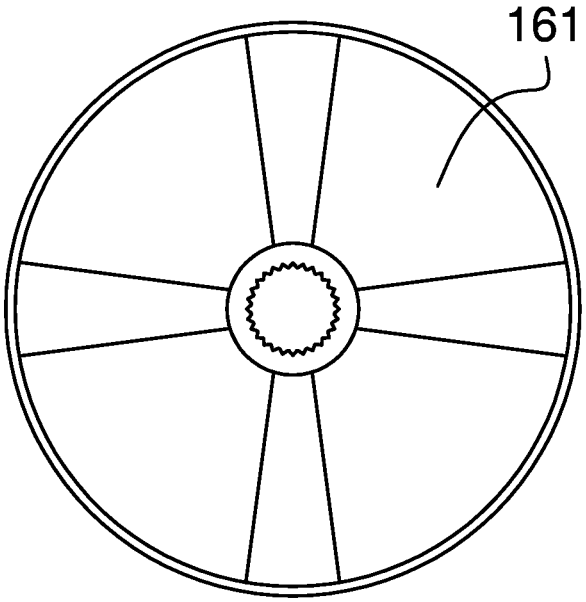
FIG. 4 is a front view of an embodiment of the disclosure.
Figure 5:
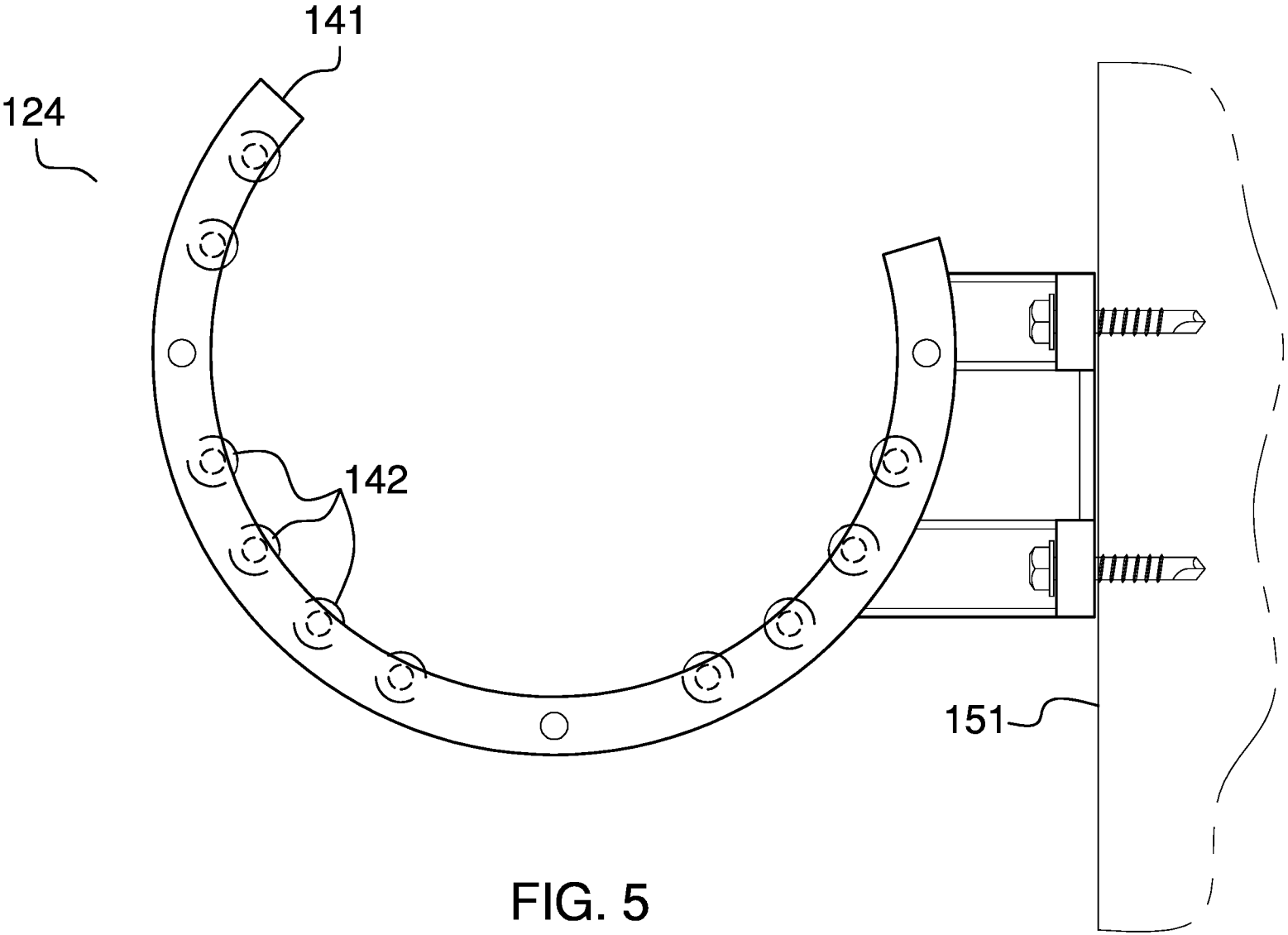
FIG. 5 is a detail view of an embodiment of the disclosure.
Figure 6:
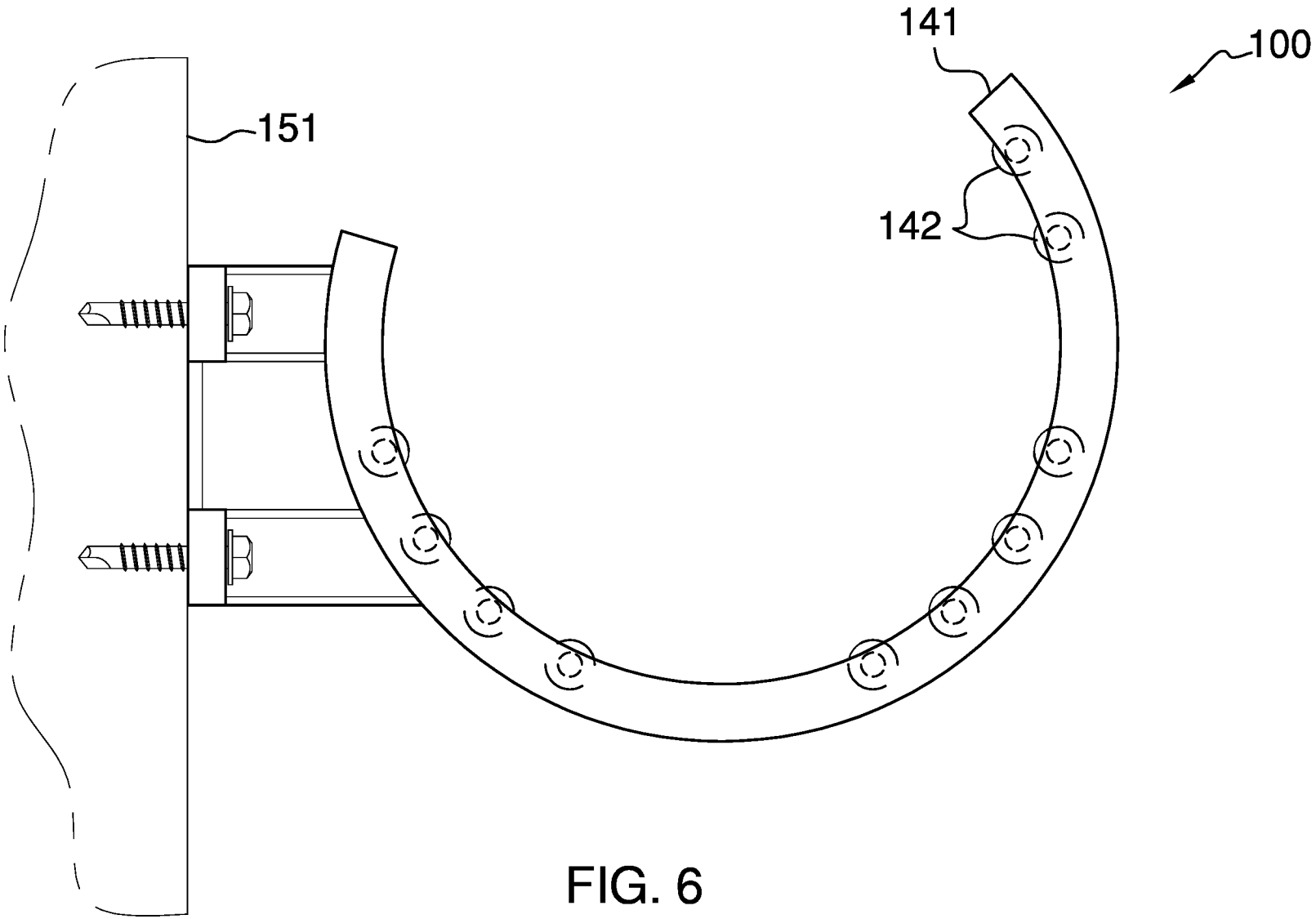
FIG. 6 is a reverse detail view of an embodiment of the disclosure.
Figure 7:
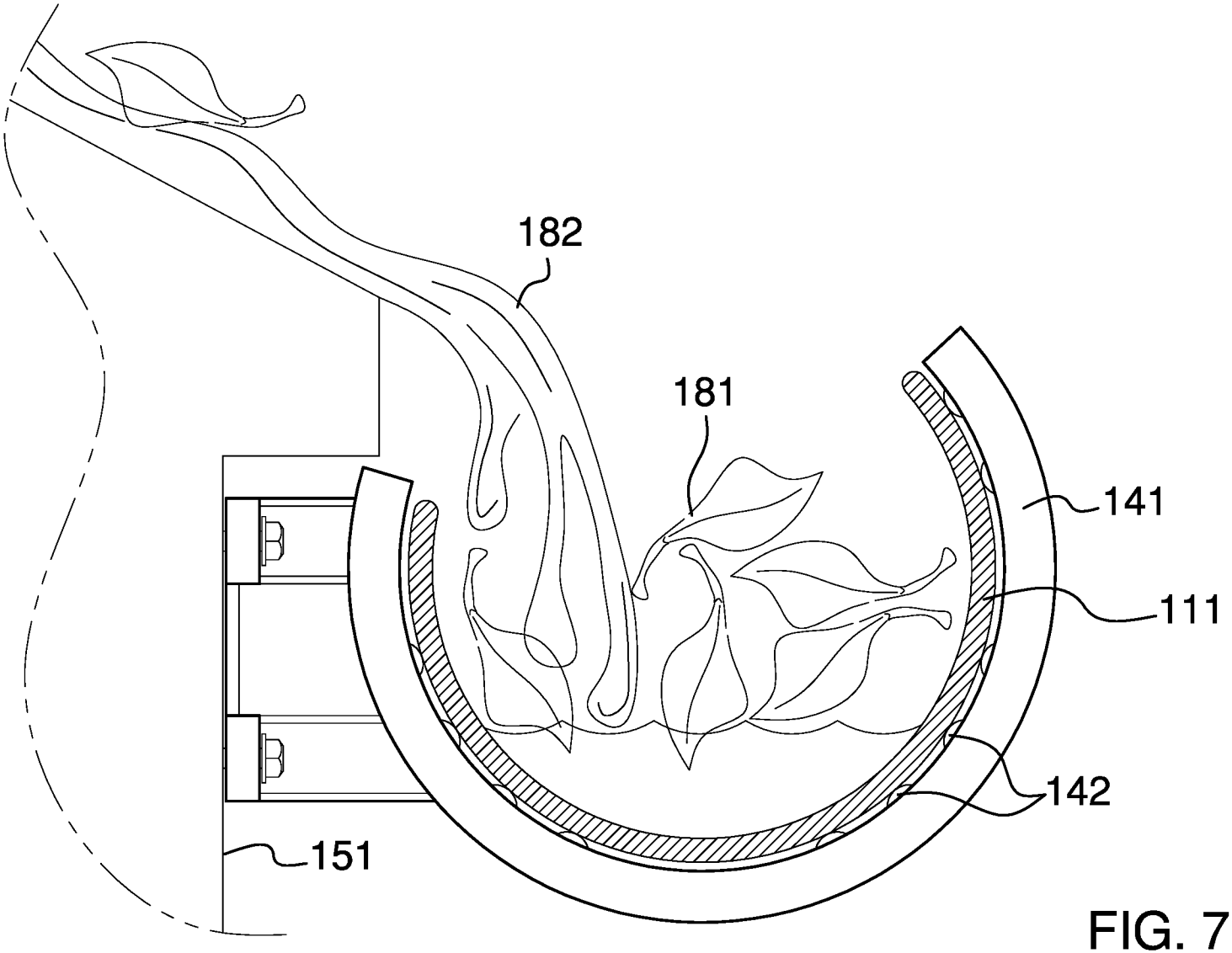
FIG. 7 is an in-use view of an embodiment of the disclosure.
Figure 8:
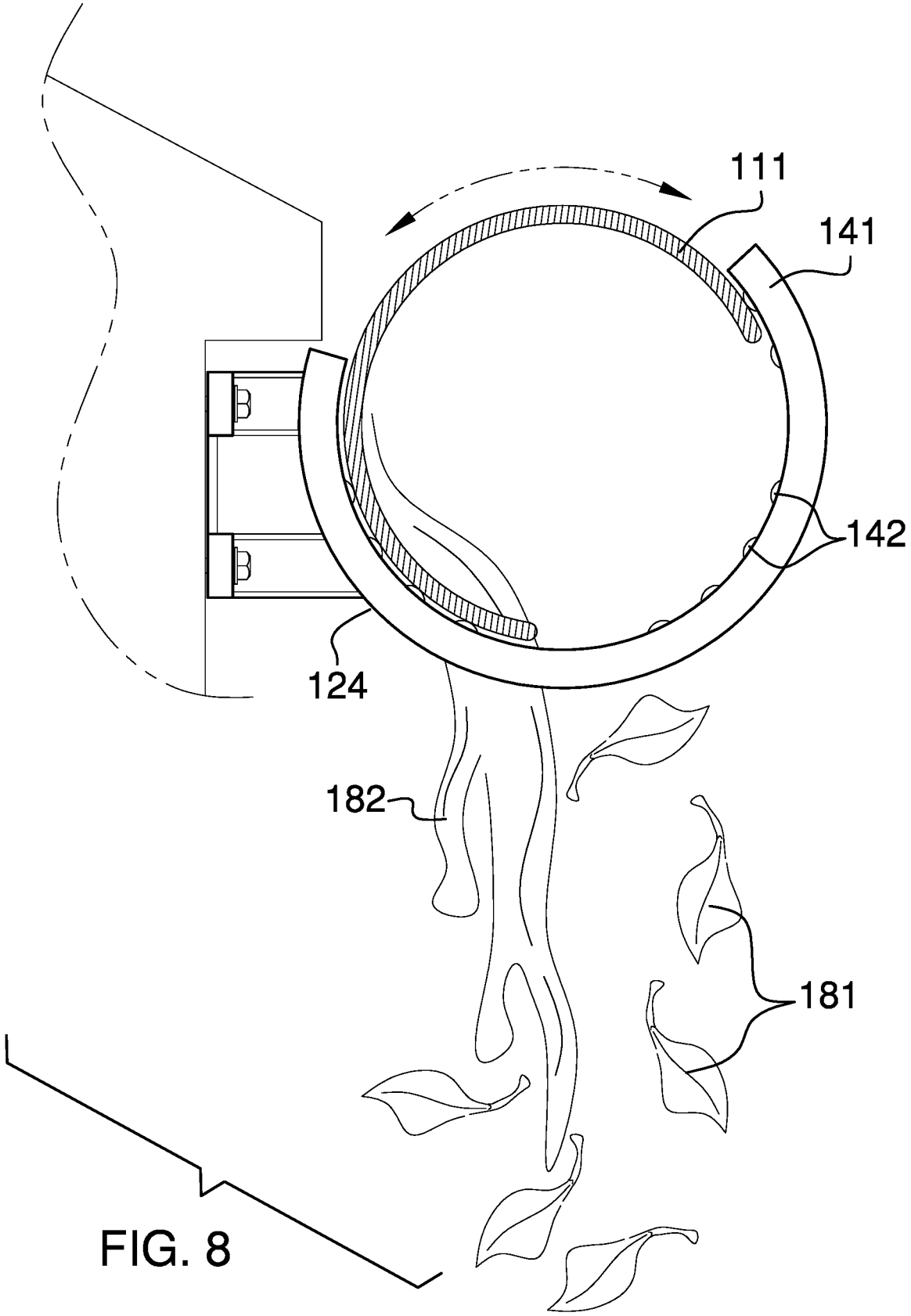
FIG. 8 is an in-use view of an embodiment of the disclosure.
Figure 9:
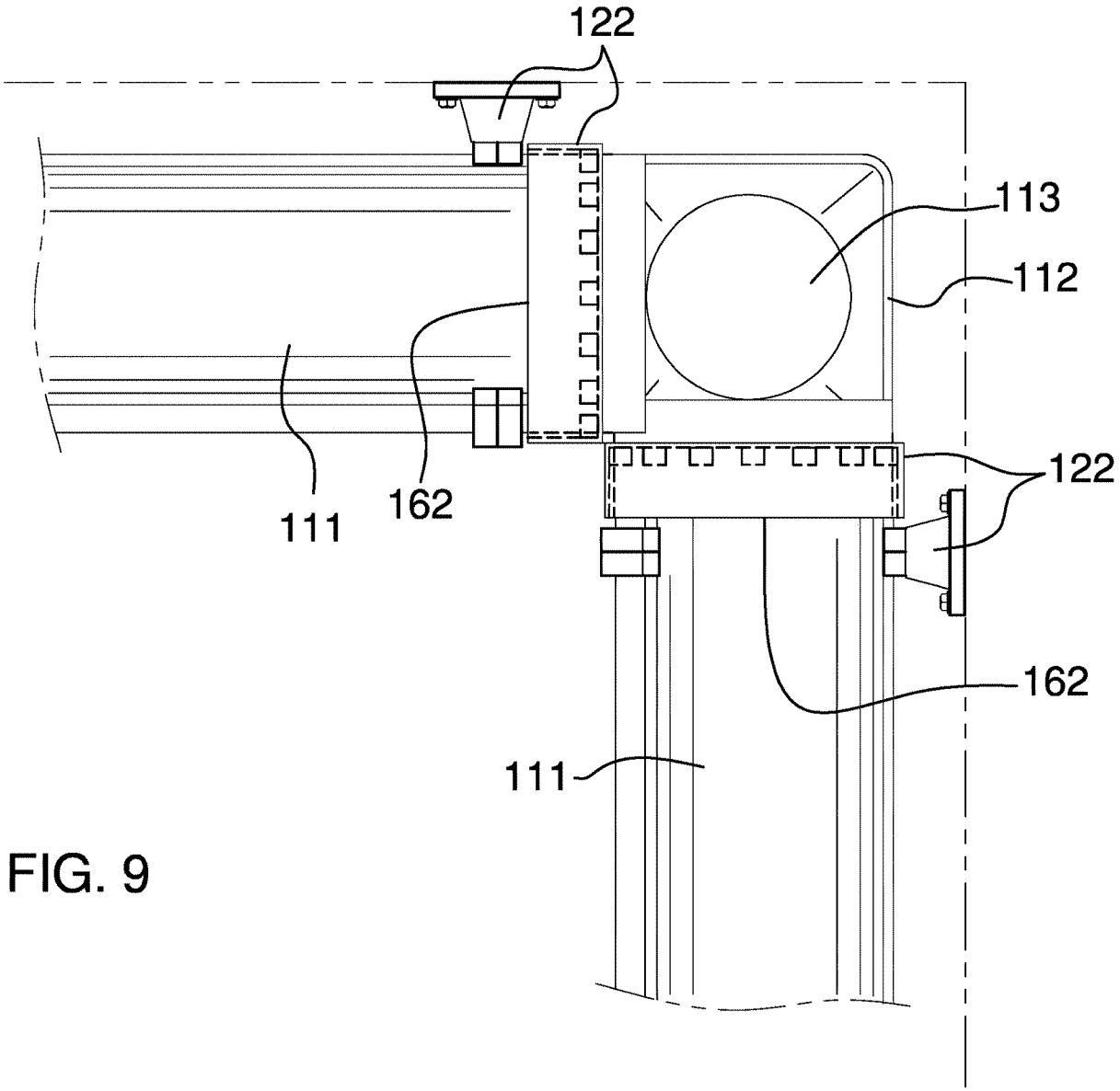
FIG. 9 is a detail view of an embodiment of the disclosure.

Detailed reference will now be made to one or more potential embodiments of the disclosure, which are illustrated in FIGS. 1 through 9.

The rotating gutter system 100 (hereinafter invention) is configured for use with a pitched roof 103. The pitched roof 103 is further defined with a fascia 151. The fascia 151 is defined in greater detail elsewhere in this disclosure. The invention 100 is configured to capture and remove water 182 from the pitched roof 103. The invention 100 is a self-cleaning system. Specifically, each gutter rotates such that debris 181 will fall out of the invention 100 allowing for the smooth flow of water 182 through the invention 100. The invention 100 is assembled in the same manner as a traditional gutter system. The invention 100 comprises a gutter structure 101 and a plurality of segmented bushings 102. The gutter structure 101 handles the collection and transport of water 182 from the pitched roof 103. The plurality of segmented bushings 102: a) attach the gutter structure 101 to the fascia 151 of the pitched roof 103; and, b) rotate the gutters contained in the gutter structure 101 in order to clean the invention 100.

The gutter structure 101 is a water 182 transport system that: a) receives water 182 from the pitched roof 103; and, b) transports the water 182 away from the pitched roof 103. The gutter structure 101 comprises a gutter run 111, a downspout connector 112, and a downspout 113. The gutter run 111 is further defined with a capped end 161 and a connecting end 162. The capped end 161 comprises the closed end of the trough structure of the gutter run 111. The capped end 161 is distal from the connecting end 162. The connecting end 162 comprises the open end of the trough structure of the gutter run 111.

The gutter run 111 is a linear structure that forms the water 182 collecting element of the gutter structure 101. The gutter run 111 forms the trough that physically collects and transports water 182 that drains off the pitched roof 103. The gutter run 111 is the element of the gutter structure 101 that is physically rotated by the plurality of segmented bushings 102. The gutter run 111 installs within the plurality of segmented bushings 102 such that the gutter run 111 cannot roll out of the plurality of segmented bushings 102.

The downspout connector 112 is a mechanical structure that forms a fluidic connection between the gutter run 111 and the downspout 113. The downspout connector 112 forms a fluidic connection between the gutter run 111 and the downspout 113 such that water 182 exits the gutter run 111 into the downspout 113.

The downspout 113 is a pipe that transports water 182 away from the gutter run 111. The downspout 113 is defined in greater detail elsewhere in this disclosure. The use of a downspout 113 is well-known and documented in the construction arts.

The plurality of segmented bushings 102 is a mechanical system that: a) attaches the gutter structure 101 to the fascia 151 of the pitched roof 103; and, b) rotates the gutter structure 101 such that debris 181 will fall out of the gutter structure 101. The plurality of segmented bushings 102 comprises a master segmented bushing 121, a downspout connector segmented bushing 122, and a plurality of support segmented bushings 123.

The plurality of segmented bushings 102 comprises a collection of individual segmented bushings 124. Each individual segmented bushing 124 selected from the plurality of segmented bushings 102 forms a support structure that: a) transfers the load path of the gutter run 111 to the fascia 151 of the pitched roof 103; and, b) enables the gutter run 111 to rotate while being supported by the individual segmented bushing 124.

Each individual segmented bushing 124 comprises a partial ring 141 and a plurality of rollers 142. The partial ring 141 of the downspout connector segmented bushing 122 attaches to the fascia 151 of the pitched roof 103. The partial ring 141 of the downspout connector segmented bushing 122 further attaches the gutter run 111 to the downspout connector 112 of the gutter structure 101.

The partial ring 141 further comprises a first arm 171 and a second arm 172.

The partial ring 141 is a ring within which the gutter run 111 is contained. The partial ring 141 attaches the gutter run 111 to the fascia 151 of the pitched roof 103. The partial ring 141 has the shape of a major circular segment. The inner diameter of the partial ring 141 is greater than the outer diameter of the gutter run 111 such that the gutter run 111 can rotate within the partial ring 141.

The plurality of rollers 142 comprises a collection of individual rollers that are mounted on the inner perimeter of the partial ring 141. Each of the plurality of rollers 142 mount in the partial ring 141 such that the rotation of each roller will roll the gutter run 111 in a direction perpendicular to the center axis of the individual segmented bushing 124.

The first arm 171 and the second arm 172 are sections of the partial ring 141 that are formed as a cross-section of the partial ring 141. As shown most clearly in FIG. 3, the first arm 171 and the second arm 172 form end pieces that capture each of the plurality of rollers 142 between the first arm 171 and the second arm 172.

The master segmented bushing 121 is a modification to an individual segmented bushing 124 selected from the plurality of support segmented bushings 123. The downspout connector segmented bushing 122 is a modification to an individual segmented bushing 124 selected from the plurality of support segmented bushings 123. The plurality of support segmented bushings 123 comprises the segmented bushings remaining in the plurality of segmented bushings 102 after the master segmented bushing 121 and the downspout connector segmented bushing 122 have been removed. Each of the plurality of support segmented bushings 123 is identical. Each of the plurality of support segmented bushings 123 attaches the gutter run 111 to the fascia 151 of the pitched roof 103. Each individual segmented bushing 124 selected from the plurality of segmented bushings 102 has the same core structure.

The master segmented bushing 121 is a segmented bushing selected from the plurality of segmented bushings 102. The master segmented bushing 121 attaches the capped end 161 of the gutter run 111 to the fascia 151 of the pitched roof 103. The master segmented bushing 121 provides the motive force that rotates the gutter run 111 such that debris 181 is discharged from the gutter run 111. The master segmented bushing 121 comprises an individual segmented bushing 124 and an electric motor 131.

The electric motor 131 is a commercially available device. The electric motor 131 comprises a rotor 132 and a stator 133. The electric motor 131 converts electrical energy into rotational energy used to rotate the gutter run 111. The electric motor 131 is defined in greater detail elsewhere in this disclosure. The rotor 132 directly attaches to the capped end 161 of the gutter run 111 such that the rotation of the rotor 132 rotates the gutter run 111. The stator 133 directly attaches to the partial ring 141 of the individual segmented bushing 124 that forms the master segmented bushing 121. The partial ring 141 of the individual segmented bushing 124 of the master segmented bushing 121 fixes the position of the stator 133 relative to the fascia 151 such that the rotation of the rotor 132 rotates the gutter run 111 relative to the fascia 151.

The electric motor 131 is remotely controlled such that the invention 100 can be operated from the ground. In the first potential embodiment of the disclosure, the electric motor 131 is operated using a commercially available 433 MHz remote control switch and transmitter 134.

The downspout connector segmented bushing 122 is a segmented bushing selected from the plurality of segmented bushings 102. The downspout connector segmented bushing 122 attaches to the fascia 151 of the pitched roof 103. The downspout connector segmented bushing 122 further forms a fluidic connection with the connecting end 162 of the gutter run 111 through the downspout connector 112 and the downspout 113. The downspout connector segmented bushing 122 transports rainfall from the connecting end 162 of the gutter run 111 to the downspout connector 112. The downspout connector 112 and the downspout connector segmented bushing 122 are not physically secured to the downspout 113 or the gutter run 111. The downspout 113 and the gutter run 111 are independently secured to the fascia 151.

The following definitions were used in this disclosure:

Bracket: As used in this disclosure, a bracket is a mechanical structure that attaches a second structure to a first structure such that the load path of the second structure is fully transferred to the first structure.

Segmented bushing: As used in this disclosure, a segmented bushing is a cylindrical aperture through which an object is guided and potentially secured. Segmented bushings are often used as protective linings.

Cant: As used in this disclosure, a cant is an angular deviation from one or more reference lines (or planes) such as a vertical line (or plane) or a horizontal line (or plane).

Circular Section: As used in this disclosure, a circular section refers one of the two objects formed by the bifurcation of a circle by a plane that does not pass through the center of the circle. The major section is the circular section that contains the larger area. The minor section is the circular section that contains the smaller area.

Cross-section: As used in this disclosure, a cross-section is a surface or shape that would be exposed by making a straight cut through the center axis of an object.

Debris: As used in this disclosure, debris refers to an accumulation of loose and unwanted material.

Downspout: As used in this disclosure, a downspout is a vertically oriented pipe that transports water from the gutter associated with a pitched roof to a location distal from the building associated with the pitched roof.

Downspout Connector: As used in this disclosure, a downspout connector is an inert mechanical structure that attaches a downspout to a gutter such that water will drain from the gutter into the downspout.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Fascia: As used in this disclosure, a fascia is a structural element (such as a wooden board) positioned between the top of a wall and the projecting eaves of a roof such that the horizontal element covers the rafters. The visible surface of the vertical element runs parallel to the direction of gravity.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connection are well-known and documented in the mechanical, chemical, and plumbing arts.

Ground: As used in this disclosure, the ground is a solid supporting surface formed by the Earth. The term level ground means that the supporting surface formed by the ground is roughly perpendicular to the force of gravity. Always use supporting surface.

Gutter: As used in this disclosure, a gutter is a trough that is placed under the edge of a roof such that the gutter will transport water away from the roof to a downspout.

Inner Diameter: As used in this disclosure, the term inner diameter is used in the same way that a plumber would refer to the inner diameter of a pipe.

Inner Perimeter and Outer Perimeter: As used in this disclosure, the inner perimeter and the outer perimeter refer to two geometrically similar structures of a curved object. The inner perimeter refers to the geometrically similar structure with the shorter span. The outer perimeter refers to the geometrically similar structure with the greater span.

Motor: As used in this disclosure, a motor refers to the method of transferring energy from an external power source into rotational mechanical energy.

Outer Diameter: As used in this disclosure, the term outer diameter is used in the same way that a plumber would refer to the outer diameter of a pipe.

Pitch: As used in this disclosure, a pitch refers to a cant formed between a line or a plane and the horizon.

Pitched Roof: As used in this disclosure; a pitched roof refers to a roof wherein the surface of the roof forms an angle relative to the horizon.

Remote Control: As used in this disclosure, remote control means the establishment of control of a device from a distance. Remote control is generally accomplished through the use of an electrical device that generates electrically based control signals that are transmitted via radio frequencies or other means to the device.

Ring: As used in this disclosure, a ring is term that is used to describe a flat or plate-like structure through which an aperture is formed. Rings are often considered loops.

Roller: As used in this disclosure, a roller is rotating cylindrical or disk structure used to reduce the friction of movement of an object supported by the roller.

Roof: As used in this disclosure, a roof is the surface of a chamber that is distal from the floor. The roof is typically the superior surface of the chamber.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Trough: As used in this disclosure, a trough is an open receptacle that is used to: 1) store a fluid in a manner accessible to an animal; or, 2) to physically determine and limit the flow path of a fluid. The rain gutter commonly seen on a building is an example of a trough.

Tradition: As used in this disclosure, a tradition refers to: 1) a set of thoughts or expectations regarding a subject or object; or, 2) a method of using an object; that, 3) is perceived to be widely or commonly shared across a population of people; and that, 4) is perceived to be widely or commonly shared across at least two generations within the population of people.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A cleaning tool comprising:

a gutter structure and a plurality of segmented bushings;

wherein the cleaning tool is configured for use with a pitched roof;

wherein the pitched roof is further defined with a fascia;

wherein the plurality of segmented bushings are configured to attach the gutter structure to the fascia;

wherein the gutter structure is a water transport system, which is configured to receive water from the pitched roof;

wherein the gutter structure is configured to transport the water away from the pitched roof;

wherein the gutter structure comprises a gutter run, a downspout connector, and a downspout;

wherein the downspout connector attaches the gutter run to the downspout;

wherein the gutter run is further defined with a capped end and a connecting end;

wherein the gutter run is physically rotated by at least one of the plurality of segmented bushings;

wherein the downspout connector forms a fluidic connection between the gutter run and the downspout;

wherein the downspout is a pipe that transports water away from the gutter run;

wherein the plurality of segmented bushings comprise a collection of individual segmented bushings;

wherein each individual segmented bushing selected from the plurality of segmented bushings forms a support structure that is configured to transfer a load path of the gutter run to the fascia of the pitched roof;

wherein each individual segmented bushing selected from the plurality of segmented bushings enables the gutter run to rotate while being supported by the individual segmented bushing;

wherein each of the individual segmented bushings comprises a partial ring and a plurality of rollers;

wherein the plurality of rollers mount in the partial ring;

wherein the partial ring is a ring within which the gutter run is contained;

wherein the partial ring is configured to attach the gutter run to the fascia of the pitched roof, wherein the plurality of segmented bushings comprises a master segmented bushing, wherein the master segmented bushing comprises one of the individual segmented bushings and an electric motor;

wherein the electric motor comprises a rotor and a stator;

wherein the rotor directly attaches to the capped end of the gutter run such that the rotation of the rotor rotates the gutter run;

wherein the stator directly attaches to the partial ring of the individual segmented bushing that forms the master segmented bushing;

wherein the partial ring of the individual segmented bushing of the master segmented bushing fixes the position of the stator relative to the fascia such that the rotation of the rotor rotates the gutter run relative to the fascia.

2. The cleaning tool according to claim 1 wherein the partial ring has the shape of a major circular segment.

3. The cleaning tool according to claim 2 wherein an inner diameter of the partial ring is greater than an outer diameter of the gutter run such that the gutter run can rotate within the partial ring.

4. The cleaning tool according to claim 3 wherein the partial ring further comprises a first arm and a second arm;

wherein the first arm and the second arm are sections of the partial ring;

wherein the first arm and the second arm are formed as a cross-section of the partial ring.

5. The cleaning tool according to claim 4 wherein the plurality of rollers comprises a collection of individual rollers;

wherein the plurality of rollers are mounted on an inner perimeter of the partial ring.

6. The cleaning tool according to claim 5 wherein each of the plurality of rollers mount in the partial ring such that the rotation of each roller will roll the gutter run in a direction perpendicular to a center axis of the individual segmented bushings.

7. The cleaning tool according to claim 6 wherein the first arm and the second arm form end pieces that capture each of the plurality of rollers between the first arm and the second arm.

8. The cleaning tool according to claim 7 wherein the plurality of segmented bushings further comprises a downspout connector segmented bushing, and a plurality of support segmented bushings;

wherein the downspout connector segmented bushing is configured to attach to the fascia of the pitched roof;

wherein the downspout connector segmented bushing further attaches to the downspout connector;

wherein the master segmented bushing is configured to attach the capped end of the gutter run to the fascia of the pitched roof;

wherein the plurality of support segmented bushings comprises the segmented bushings remaining in the plurality of segmented bushings after the master segmented bushing and the downspout connector segmented bushing are removed.

9. The cleaning tool according to claim 8 wherein each of the plurality of support segmented bushings is identical;

wherein each of the plurality of support segmented bushings is configured to attach the gutter run to the fascia of the pitched roof;

wherein each of the plurality of support segmented bushings is an individual segmented bushing.

10. The cleaning tool according to claim 1 wherein the master segmented bushing provides the motive force that rotates the gutter run such that debris is discharged from the gutter run.

11. The cleaning tool according to claim 8 wherein the downspout connector segmented bushing is configured to attach the connecting end of the gutter run to the fascia of the pitched roof;

wherein the downspout connector segmented bushing further attaches the connecting end of the gutter run to the downspout connector and the downspout.

* * * * *